US006909204B2

(12) United States Patent
Batey

(10) Patent No.: US 6,909,204 B2
(45) Date of Patent: Jun. 21, 2005

(54) SYSTEM FOR SEQUENCING A FIRST NODE VOLTAGE AND A SECOND NODE VOLTAGE

(75) Inventor: Robert M. Batey, Eagle, ID (US)

(73) Assignee: Agilent Technologies, Inc., Palo Alto, CA (US)

( * ) Notice: Subject to any disclaimer, the term of this patent is extended or adjusted under 35 U.S.C. 154(b) by 63 days.

(21) Appl. No.: 10/404,269

(22) Filed: Apr. 1, 2003

(65) Prior Publication Data

US 2004/0196011 A1 Oct. 7, 2004

(51) Int. Cl.[7] ..... H01H 35/00; G05F 1/40

(52) U.S. Cl. ..... 307/130; 323/273

(58) Field of Search ..... 323/268, 270, 323/273, 282; 307/80, 85–87, 125, 126, 130, 131; 327/142, 143, 530, 539, 535, 538, 540

(56) References Cited

U.S. PATENT DOCUMENTS 4,670,668 A * 6/1987 Liu ..... 327/537
5,734,585 A 3/1998 Beard
5,763,960 A 6/1998 Ceccherelli et al.
5,811,962 A 9/1998 Ceccherelli et al.
6,236,250 B1 5/2001 Salmon et al.
6,316,924 B1 11/2001 Stapleton et al.
6,335,637 B1 1/2002 Correale, Jr. et al.
6,407,898 B1 6/2002 Wu
6,429,706 B1 8/2002 Amin et al.
6,462,438 B1 10/2002 Stapleton et al.
6,642,750 B1 * 11/2003 Egan ..... 327/63
6,671,816 B1 * 12/2003 Woo ..... 713/330
6,693,410 B1 * 2/2004 Terrien ..... 323/274

* cited by examiner

*Primary Examiner*—Matthew V. Nguyen

(57) ABSTRACT

A sequencing system for sequencing a first node voltage at a first node and a second node voltage at a second node which is less than the first node voltage is disclosed. The sequencing system includes a bias circuit configured to provide a bias current in response to the first node voltage beginning to change to a first supply voltage. The sequencing system includes a switch configured to provide a low impedance path between the first node and the second node when the bias circuit is providing the bias current. The switch is configured to provide a high impedance path when the second node voltage is within a range of a second supply voltage which is less than the first supply voltage.

24 Claims, 4 Drawing Sheets

SYSTEM FOR SEQUENCING A FIRST NODE VOLTAGE AND A SECOND NODE VOLTAGE

THE FIELD OF THE INVENTION

The present invention relates to a sequencing system, and more particularly, to a sequencing system for sequencing a first node voltage and a second node voltage.

BACKGROUND OF THE INVENTION

Integrated circuits (ICs) can operate at two power supply voltages to minimize power consumption while improving performance. The integrated circuits used in dual voltage supply applications are typically designed to have internal or core logic which operates at one voltage level, and input/output (I/O) circuits which operate at another voltage level. The power supply voltage level used by the core logic is usually selected to be within voltage limits dictated by IC process design rules which maximize logic density. The higher power supply voltages used by the I/O circuits maximize IC drive capability or switching speed.

ICs which use dual power supplies often times require that a certain sequence be followed during activation of the supplies. This is because random application of the supply voltages to the I/O circuits and the core logic can result in unintended logic states being passed between the core logic and the I/O circuits. Even worse, catastrophic failures of the ICs can result if latch-up is triggered by the random application of the supply voltages.

One problem that can occur from unintended logic states is bus contention. Bus contention occurs at a system level when the core logic is powered-up after the I/O circuits are powered-up, and the bi-directional I/O pins driven by the I/O circuits are unintentionally configured as outputs. Typically, the control logic which selects the configuration of the I/O circuits as either inputs or outputs is located in the core logic. When the I/O circuitry is powered-up before the core logic, the input or output configuration of the I/O circuit is unknown, and bus contention can result. When the I/O pins of the IC attempt to drive other I/O pins of other external devices which are also configured as outputs, a high current condition can occur which results in physical damage of the IC.

Another problem that can occur from random application of the supply voltages to the I/O circuits and the core logic is the corruption of data stored within the IC. This occurs when stored logic states within the core logic are unintentionally changed.

Random application of the supply voltages can result in reduced performance levels if the power supplies provide supply voltages at different points in time. This is because ICs which operate at two supply voltages are usually not operated until the possibility of unintended logic states occurring is minimized, which is after both of the supply voltages are valid.

In view of the above, there is a need for a sequencing system which improves performance and reduces the possibility of data loss or damage to the IC resulting from random application of the supply voltages to the IC.

SUMMARY OF THE INVENTION

One aspect of the present invention provides a sequencing system tar sequencing a first node voltage at a first node and a second node voltage at a second node which is less than the first node voltage. The sequencing system includes a bias circuit configured to provide a bias current in response to the first node voltage beginning to change to a first supply voltage. The sequencing system includes a switch configured to provide a low impedance path between the first node and the second node when the bias circuit is providing the bias current. The switch is configured to provide a high impedance path when the second node voltage is within a range of a second supply voltage which is less than the first supply voltage.

DETAILED DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
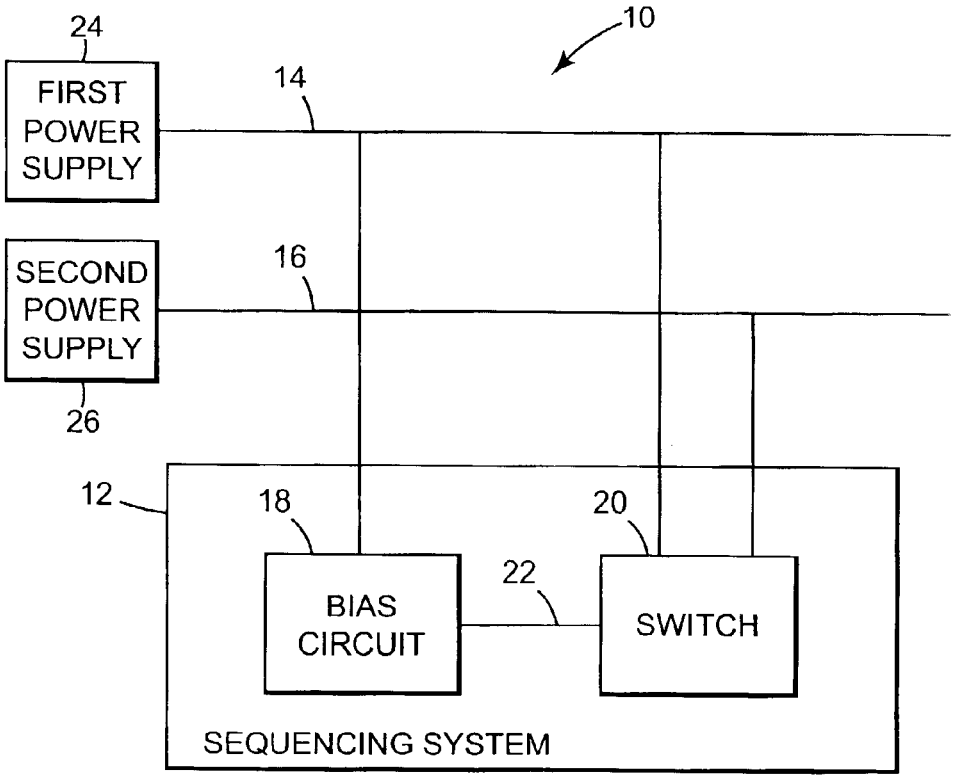
FIG. 1 is a diagram illustrating one exemplary embodiment of a sequencing system coupled to a first power supply and a second power supply.

FIG. 1 is a diagram illustrating one exemplary embodiment at 10 of a sequencing system 12 coupled to a first power supply 24 and a second power supply 26. Sequencing system 12 is coupled to a first node 14 and a second node 16. First power supply 24 supplies a first supply voltage to the first node 14. Second power supply 26 supplies a second supply voltage to the second node 16. When first power supply 24 is activated or switched on, the first node voltage changes to the first supply voltage. When second power supply 26 is activated or switched on, the second node voltage changes to the second supply voltage. In various embodiments, the second supply voltage is less than the first supply voltage. For example, in one embodiment, the first supply voltage provided by first power supply 24 is equal to 3.3 volts, and the second supply voltage provided by second power supply 26 is equal to 1.5 volts. In other embodiments, the first supply voltage and the second supply voltage can be other suitable values. In the exemplary embodiment illustrated at 10, the second node voltage at second node 16 is less than the first node voltage at first node 14 when first power supply 24 and second power supply 26 are activated or switched on.

In the exemplary embodiment, sequencing system 12 includes a bias circuit 18 which is configured to provide a bias current once the first node voltage at node 14 begins changing to the first supply voltage. In one embodiment, the first node voltage begins changing when the first power supply 24 is activated. Sequencing system 12 also includes a switch 20 which is configured to provide a low impedance path between the first node 14 and the second node 16. The low impedance path is provided when bias circuit 18 is providing the bias current via line 22 to switch 20. In the exemplary embodiment, sequencing system 12 sequences the first node voltage or first supply voltage and the second node voltage or second supply voltage by providing a low impedance path between the first node 14 and the second node 16. The low impedance path enables the second node voltage to be pulled up to be approximately equal to the second supply voltage, even though the second power supply 26 has not yet changed the second node voltage to the second supply voltage.

Figure 4:
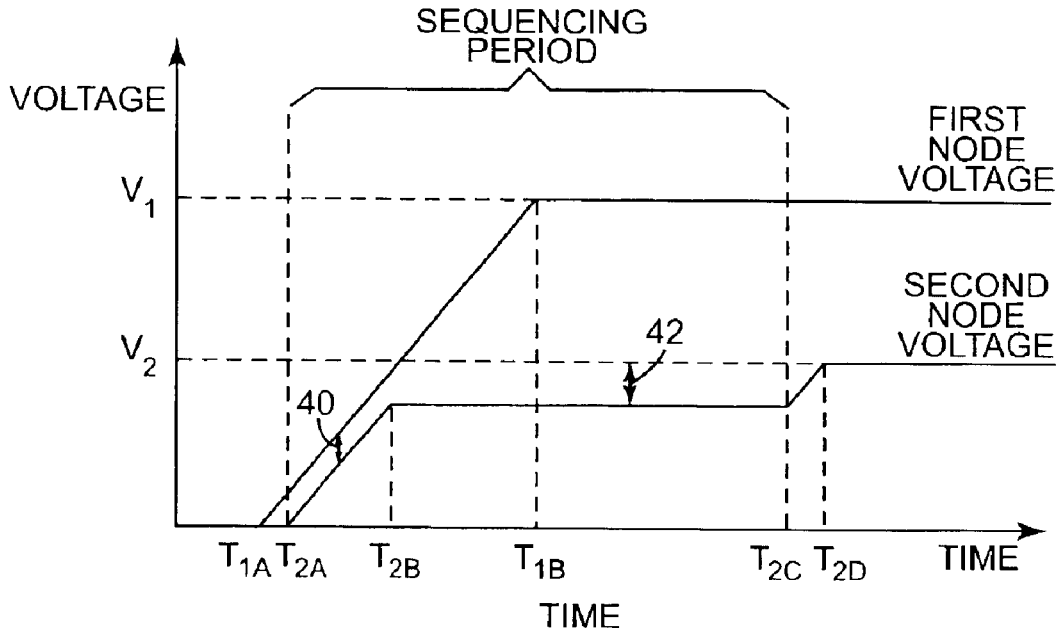
FIG. 4 is a diagram illustrating one exemplary embodiment of a first node voltage and a second node voltage versus time for first and second nodes that are sequenced.

In the exemplary embodiment, after the second node voltage has increased to be within a range of the second supply voltage, switch 20 is configured to provide a high impedance path because the second node voltage is being supplied by second power supply 26, and not by first power supply 24 (see also, FIG. 4).

In the exemplary embodiment the first supply voltage and the second supply voltage are provided by the first power supply 24 and the second power supply 26, in other embodiments, any one or more of the power supplies or other voltage sources can be coupled to the first node 14 and the second node 16 to provide the first supply voltage to the first node 14 and the second supply voltage to the second node 16. In the exemplary embodiment, when the first power supply 24 is activated or switched on, the first node voltage changes from a ground potential to the first supply voltage. When the second power supply 26 is activated or switched on, the second node voltage changes from the ground potential to the second supply voltage. In other embodiments, the first node voltage can change from other suitable voltage levels to the first supply voltage, and the second node voltage can change from other suitable voltage levels to the second supply voltage.

Figure 2:
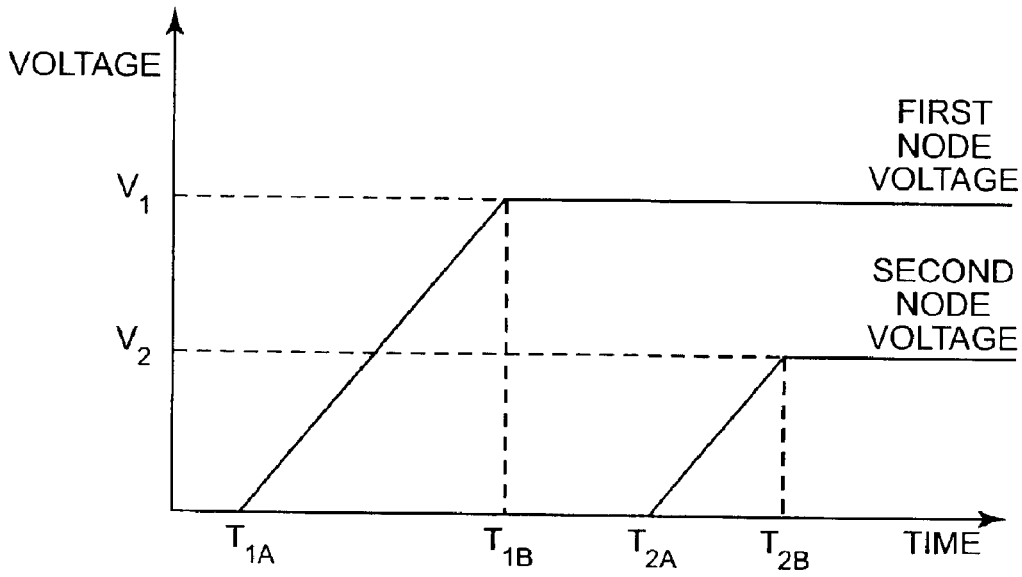
FIG. 2 is a diagram illustrating one exemplary embodiment of a first node voltage and a second node voltage versus time for first and second nodes that are not sequenced.

FIG. 2 is a diagram illustrating one exemplary embodiment of a first node voltage and a second node voltage versus time for first and second nodes 14 and 16 that are not sequenced. The first power supply 24 changes the first node voltage at node 14 to the first supply voltage illustrated as $V_1$. The second power supply 26 changes the second node voltage at node 16 to the second supply voltage illustrated as $V_2$. In the exemplary embodiment, the second supply voltage $V_2$ is less than the first supply voltage $V_1$.

In various embodiments, integrated circuits (ICs) can operate at two power supply voltages to minimize power consumption and improve performance. The first supply voltage $V_1$ and the second supply voltage $V_2$ can be any suitable voltage level for dual voltage supply applications. In one embodiment, an integrated circuit has input/output (I/O) circuits which operate at the first supply voltage $V_1$, and has internal core logic which operates at the second supply voltage $V_2$. In other embodiments, the I/O circuits operate at the second supply voltage $V_2$, and the internal core logic operates at the first supply voltage $V_1$.

In the exemplary embodiment, the first node voltage begins changing from an initial voltage value at time $T_{1A}$ to the first supply voltage $V_1$ and is equal to $V_1$ at time $T_{1B}$. The second node voltage begins changing from an initial voltage value at time $T_{2A}$ to the first supply voltage $V_2$ and is equal to $V_2$ at time $T_{2B}$. The first node voltage begins changing from the initial voltage value at time $T_{1A}$ before the second node voltage begins changing from the initial voltage value at time $T_{2A}$. In one embodiment, the initial voltage value at times $T_{1A}$ and $T_{2A}$ for the first node voltage and the second node voltage is equal to the ground potential or zero volts. In other embodiments, the initial voltage value for the first node voltage at time $T_{1A}$ and for the second node voltage at time $T_{2A}$ can be other suitable values which are either equal or not equal. In the exemplary embodiment, before the first power supply 24 and the second power supply 26 are activated, their respective outputs at first node 14 and second node 16 are equal to the initial voltage value.

Figure 3:
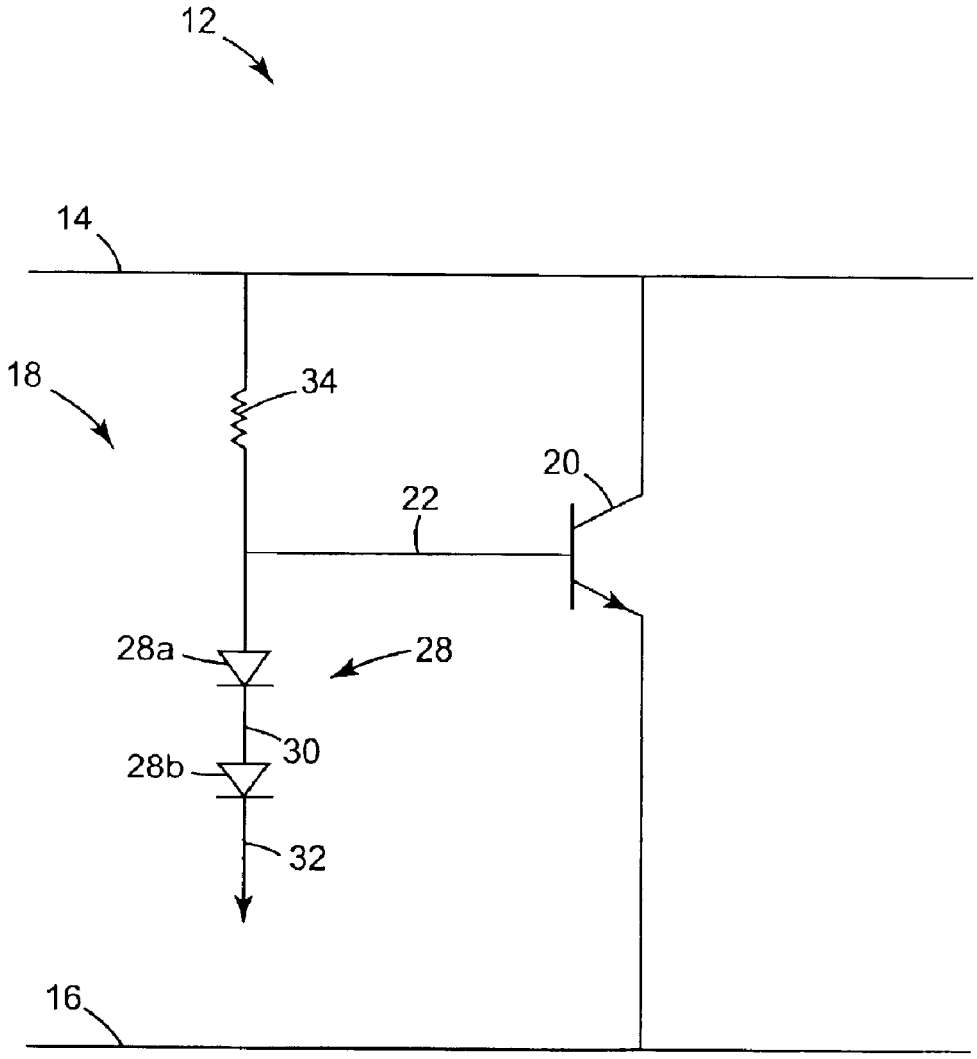
FIG. 3 is a schematic diagram illustrating one exemplary embodiment of a sequencing system which includes a bias circuit and a switch.

FIG. 3 is a schematic diagram illustrating one exemplary embodiment of a sequencing system 12 which includes a bias circuit 18 and a switch 20. In the exemplary embodiment, bias circuit 18 functions as an input circuit for switch 20 and includes a voltage reference circuit 28. Voltage reference circuit 28 includes a diode 28*a* and a diode 28*b* which are coupled together in series between lines 22 and 30, and 30 and 32, respectively. Line 32 is at the ground potential. The diodes 28 are configured to be forward biased when the first node voltage at node 14 is equal to or greater than a sum of the forward bias voltage drops of diodes 28*a* and 28*b*. The reference voltage is equal to the sum of the forward bias voltage drops of diodes 28*a* and 28*b*. While two diodes 28*a* and 28*b* are illustrated in FIG. 2, in other embodiments, any suitable number of one or more diodes can be used.

In one embodiment, the diodes 28 are silicon diodes. In various embodiments, silicon diodes have a forward bias voltage drop which is between 0.9 volts and 1.1 volts. The reference voltage is set by determining the number of diodes 28 to couple together in series so that the forward bias voltage drops of the diodes 28 sum to the desired reference voltage.

In one embodiment, the diodes 28 are Schottkey barrier diodes. In various embodiments, the Schottkey diodes have a forward bias voltage drop which is between 0.12 volts and 0.8 volts. The reference voltage is set by determining the number of diodes 28 to couple together in series so that the forward bias voltage drops of the diodes 28 sum to the desired reference voltage.

In the exemplary embodiment, the switch 20 is a bipolar transistor. The bipolar transistor 20 has a base coupled to line 22, a collector coupled to the first node 14, and an emitter coupled to the second node 16. In other embodiments, the switch 20 can be any suitable device which can be selected to provide either a low impedance path or a high impedance path between the first node 14 and the second node 16, or which can be selected to either conduct current or not conduct current between the first node 14 and the second node 16. While the bipolar transistor illustrated in FIG. 3 is an NPN bipolar transistor, in other embodiments, the bipolar transistor can be a PNP bipolar transistor. In other embodiments, the switch 20 can be other suitable transistor types. In one embodiment, the switch 20 is a complementary metal-oxide semiconductor (CMOS) transistor. In one embodiment, the switch 20 is an enhancement-mode pseudomorphic high-electron mobility (E-pHEMT) transistor.

In the exemplary embodiment, bias circuit 18 includes a conducting circuit 34 which is configured to provide the bias current to input 22 of bipolar transistor 20. In the exemplary embodiment, conducting circuit 34 is a resistor 34. In other embodiments, conducting circuit 34 can be other suitable devices which conduct the bias current.

In the exemplary embodiment, sequencing system 12 sequences the first node voltage at the first node 14 and the second node voltage at the second node 16 by conducting current between the first node 14 and the second node 16. In the exemplary embodiment, the first node voltage is greater than the second node voltage and the first supply voltage $V_1$ is greater than the second supply voltage $V_2$. Bipolar transistor 20 is configured to be in a forward active regime of operation during sequencing (or during a sequencing period), and conduct current between the first node 14 and the second node 16. The sequencing period corresponds to the period of time in which sequencing system 12 is sequencing the first node voltage and the second node voltage (or alternatively, the first power supply 24 and the second power supply 26). The sequencing period begins when the first node voltage is sufficiently greater than the second node voltage to forward bias the base to emitter junction of bipolar transistor 20 (between line 22 and second node 16). Bipolar transistor 20 provides a low impedance path between the first node 14 and the second node 16 when biased in the forward active mode. In one embodiment, bipolar transistor 20 conducts current between the first node 14 and the second node 16 when biased in the forward active mode.

In the exemplary embodiment, at the end of the sequencing period, the second power supply 26 has increased the second node voltage at second node 16 such that the second node voltage is no longer being derived from the first node voltage at the first node 14. At the end of the sequencing period, the second node voltage is within the range of the second supply voltage, and bipolar transistor 20 is biased off into the cut-off regime of operation (see also, FIG. 4). Bipolar transistor 20 provides a high impedance path between the first node 14 and the second node 16 when biased in the cut-off mode. In one embodiment, bipolar transistor 20 does not conduct current between the first node 14 and the second node 16 when biased in the cut-off mode.

In the exemplary embodiment, bias circuit 18 controls the duration of the sequencing period by controlling the bias current and the reference voltage. The bias current provided by bias circuit 18 biases bipolar transistor 20 into the forward active mode to initiate the sequencing period. The reference voltage defines the end of the sequencing period by setting a minimum second node voltage at which the bipolar transistor 20 is biased off into the cut-off mode.

FIG. 4 is a diagram illustrating one exemplary embodiment of a first node voltage and a second node voltage versus time for a first node 14 and a second node 16 that are sequenced. When the first node voltage and the second node voltage are sequenced in accordance with the exemplary embodiment, the first node voltage as a function of time illustrated in FIG. 4 has the same characteristics as the first node voltage as a function of time illustrated in FIG. 2. The characteristic of the second node voltage as a function of time has changed as a result of sequencing by sequencing system 12. In the exemplary embodiment, the first node voltage changes from a ground potential to the first supply voltage at $V_1$ and the second node voltage changes from the ground potential to the second supply voltage at $V_2$.

In the exemplary embodiment, the first node voltage begins changing from an initial voltage value at time $T_{1A}$ to the first supply voltage $V_1$ and is equal to $V_1$ at time $T_{1B}$. The second node voltage is sequenced and begins changing from an initial voltage value at time $T_{2A}$. A difference between time $T_{1A}$ and time $T_{2A}$ is less in FIG. 4 than in FIG. 2, because in the exemplary embodiment illustrated in FIG. 4, the first node voltage and the second node voltage are sequenced.

Between time $T_{2A}$ and time $T_{2B}$, the second node voltage rises in proportion to the first node voltage. Time $T_{2A}$ is the start of the sequencing period which is the time period in which sequencing system 12 is sequencing the first node voltage and the second node voltage. Between the times $T_{2A}$ and $T_{2B}$, the difference between the first node voltage and the second node voltage is illustrated at 40. During this period, bias circuit 18 is providing the bias current, bipolar transistor 20 is providing a low impedance path between the first node 14 and the second node 16, and the second node voltage is being derived from the first node voltage. Bipolar transistor 20 is operating in the forward active regime and is conducting current between the first node 14 and the second node 16. The voltage difference at 40 is equal to the base to emitter voltage drop of bipolar transistor 20 between line 22 and node 16.

Between time $T_{2B}$ and $T_{2C}$, the bipolar transistor 20 is operating in the forward active regime and the reference voltage at the base of bipolar transistor limits the second node voltage at second node 16. A range 42 between the times $T_{2B}$ and $T_{2C}$ is equal to a sum of a base to emitter voltage drop of the bipolar transistor 20 and a difference between the second supply voltage $V_2$ and the reference voltage. The reference voltage is provided by diodes 28 when diodes 28 are forward biased. The reference voltage is equal to the sum of the forward bias voltage drops of diodes 28.

Time $T_{2C}$ represents the end of the sequencing period. For times greater than $T_{2C}$, the second node voltage is within a range 42 of the second supply voltage $V_2$ and bipolar transistor 20 is biased in the cut-off regime. When biased in the cut-off regime, bipolar transistor 20 provides a high impedance path between the first node 14 and the second node 16. The second node voltage is within the range 42 when the second node voltage is greater than a difference between the second supply voltage $V_2$ and the range 42.

During the sequencing period which is between times $T_{2A}$ and $T_{2C}$, bipolar transistor 20 is operating in a forward active mode and conducts current between the first node 14 and the second node 16. The bias circuit 18 provides the bias current to bipolar transistor 20 and biases bipolar transistor 20 into the forward active mode when the second node voltage is less than the reference voltage. After the sequencing period ends (e.g. for times greater than $T_{2C}$), the bipolar transistor 20 is operating in a cut-off mode and does not conduct current between the first node 14 and the second node 16. Bipolar transistor 20 is biased in the cut-off mode when the second node voltage is equal to or greater than the reference voltage.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A sequencing system for sequencing a first node voltage at a first node and a second node voltage at a second node which is less than the first node voltage, comprising:

a bias circuit configured to provide a bias current in response to the first node voltage beginning to change to a first supply voltage, wherein the bias circuit includes a voltage reference circuit configured to provide a reference voltage; and a switch having an input configured to receive the reference voltage, wherein the switch is configured to provide a low impedance path between the first node and the second node when the bias circuit is providing the bias current, wherein the switch is configured to provide a high impedance path when the second node voltage is within a range of a second supply voltage which is less than the first supply voltage, wherein the reference voltage is equal to or less than the second supply voltage, wherein the range is equal to or greater than a difference between the second supply voltage and the reference voltage.

2. The sequencing system of claim 1, comprising:

at least one power supply coupled to the first node and the second node configured to provide the first supply voltage to the first node and to provide the second supply voltage to the second node.

3. The sequencing system of claim 1, wherein the first node voltage changes from a ground potential to the first supply voltage and the second node voltage changes from the ground potential to the second supply voltage.

4. The sequencing system of claim 1, wherein the bias circuit includes:

a conducting circuit configured to conduct the bias current between the first node and the input of the switch.

5. The sequencing system of claim 4, wherein the switch is a bipolar transistor and the input of the switch is a base of the bipolar transistor, wherein the bipolar transistor has a collector and an emitter coupled to the first and the second nodes.

6. The sequencing system of claim 5, wherein the range is equal to a sum of a base to emitter voltage drop of the bipolar transistor and a difference between the second supply voltage and the reference voltage.

7. The sequencing system of claim 4, wherein the conducting circuit is a resistor.

8. The sequencing system of claim 4, wherein the voltage reference circuit includes one or more diodes coupled in series which are configured to be forward biased when the first node voltage is equal to or greater than a sum of forward bias voltage drops of the diodes, wherein the reference voltage is equal to the sum of the forward bias voltage drops of the diodes.

9. The sequencing system of claim 8, wherein the diodes are silicon diodes.

10. The sequencing system of claim 9, wherein the diodes are Schottky barrier diodes.

11. A current routing circuit for conducting current between a first node which has a first node voltage and a second node which has a second node voltage which is less than the first node voltage, comprising:

a current amplifier coupled between the first node and the second node, wherein the current amplifier is configured to conduct current between the first node and the second node when the current amplifier is in a forward active mode and to not conduct current between the first node and the second node when the current amplifier is in a cut-off mode; and an input circuit coupled to the current amplifier and configured to bias the current amplifier into the forward active mode during a sequencing period in response to the first node voltage beginning to change to a first supply voltage and into the cut-off mode after the sequencing period, wherein the input circuit is configured to provide a reference voltage to the current amplifier, wherein the current amplifier is biased into the cut-off mode when the second node voltage is equal to or greater than the reference voltage, wherein the reference voltage is equal to or less than a second supply voltage at the second node which is less than the first supply voltage.

12. The current routing circuit of claim 11, wherein the input circuit is configured to provide a bias current to the current amplifier, and wherein the current amplifier is biased in the forward active mode when the second node voltage is less than the reference voltage.

13. The current routing circuit of claim 12, wherein the first node voltage changes from an initial voltage value to the first supply voltage and the second node voltage changes from the initial voltage value to the second supply voltage, wherein the first node voltage begins changing from the initial voltage value before the second node voltage begins changing from the initial voltage value, wherein before the sequencing period, the first node voltage and the second node voltage are equal to the initial voltage value.

14. The current routing circuit of claim 13, wherein the initial voltage value is equal to a ground potential.

15. The current routing circuit of claim 11, wherein a first power supply changes the first node voltage to the first supply voltage and a second power supply changes the second node voltage to the second supply voltage.

16. The current routing circuit of claim 11, wherein the current amplifier is a bipolar transistor, wherein a base of the bipolar transistor is coupled to the input circuit, and wherein a collector and an emitter of the bipolar transistor are coupled to the first node and the second node.

17. The current routing circuit of claim 11, wherein the input circuit comprises:

a resistor coupled at a first end to the first node; and one or more diodes connected in series between a second end of the resistor and a ground potential, wherein the diodes are configured to provide the reference voltage which is equal to a sum of the forward bias voltage drops of the diodes when the first node voltage is equal to or greater than the reference voltage.

18. The current routing circuit of claim 17, wherein the diodes comprise silicon diodes.

19. The current routing circuit of claim 17, wherein the diodes comprise Schottky barrier diodes.

20. A sequencing circuit for sequencing a first node voltage at a first node and a second node voltage at a second node which is less than the first node voltage, comprising:

a resistor coupled at a first end to the first node;

one or more diodes connected in series between a second end of the resistor and a ground potential; and a bipolar transistor having a base coupled to the second end of the resistor, a collector coupled to the first node and an emitter coupled to the second node, wherein the transistor is configured to couple the first node to the second node to pull up the second node voltage to approximately a second supply voltage in response to the first node voltage beginning to change to a first supply voltage, wherein the first supply voltage is greater than the second supply voltage.

21. A method of sequencing a first node voltage at a first node and a second node voltage at a second node which is less than the first node voltage, comprising:

biasing a switch on into a low impedance state by providing a bias current to the switch in response to the first node voltage beginning to change to a first supply voltage;

biasing the switch off into a high impedance state when the second node voltage is within a range of a second supply voltage which is less than the first supply voltage, wherein biasing the switch off includes:

providing a reference voltage to the switch, wherein the reference voltage is equal to or less than the second supply voltage, wherein the range is equal to or greater than a difference between the second supply voltage and the reference voltage.

22. A method of conducting current between a first node which has a first node voltage and a second node which has a second node voltage which is less than the first node voltage, comprising:

biasing a current amplifier into a forward active mode during a sequencing period in response to the first node voltage beginning to change to a first supply voltage to conduct current between the first node and the second node; and biasing the current amplifier into a cut-off mode after the sequencing period so that no current is conducted between the first node and the second node, wherein biasing the current amplifier into the cut-off mode includes providing a reference voltage to the current amplifier to bias the current amplifier into the cut-off mode when the second node voltage is equal to or greater than the reference voltage, wherein the reference voltage is equal to or less than a second supply voltage at the second node which is less than the first supply voltage.

23. The method of claim 22, wherein biasing the current amplifier into the forward active mode includes providing a bias current to the current amplifier to bias the current amplifier into the forward active mode when the second node voltage is less than the reference voltage.

24. The method of claim 23, wherein the first node voltage changes from an initial voltage value to the first supply voltage and the second node voltage changes from the initial voltage value to the second supply voltage, wherein the first node voltage begins changing from the initial voltage value before the second node voltage begins changing from the initial voltage value, wherein before the sequencing period, the first node voltage and the second node voltage are equal to the initial voltage value.

* * * * *